US005218381A

United States Patent [19]

Narang et al.

[11] Patent Number: 5,218,381

[45] Date of Patent: Jun. 8, 1993

[54] HYDROPHOBIC COATING FOR A FRONT FACE OF A PRINTHEAD IN AN INK JET PRINTER

[75] Inventors: Ram S. Narang, Fairport; Stephen F. Pond; Robert P. Altavela, both of Pittsford; David J. Collins, Fairport; Robert A. Harold, Sr., Rochester, all of N.Y.

[73] Assignee: Xerox Corporation, Stamford, Conn.

[21] Appl. No.: 874,865

[22] Filed: Apr. 28, 1992

[51] Int. Cl.[5] ..... B41J 2/14; B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,392,907 | 7/1983 | Shirato et al. | 346/140 R |
| 4,552,062 | 11/1985 | You | 346/140 R |
| 4,583,690 | 4/1986 | You | 346/140 R |
| 5,010,356 | 4/1991 | Albinson | 346/140 R |
| 5,017,946 | 5/1991 | Masuda | 346/140 R |
| 5,136,310 | 8/1992 | Drews | 346/140 R |

*Primary Examiner*—Joseph W. Hartray

*Attorney, Agent, or Firm*—Oliff & Berridge

[57] ABSTRACT

A coating for a front face of printhead in a thermal ink jet printer enables the directionality of an ink jet to be maintained for the printing lifetime of the printer. The coating controls the wetting characteristics of the front face to prevent ink accumulation on the front face. The coating comprises an epoxy adhesive resin such as EPON 1001F doped with a silicone rubber compound such as RTV 732. The coating can be provided in the form of a 24% solution of EPON 1001F in a 30:70 mixture of xylene and methyl iso-butyl ketone by weight doped with 1% by weight of RTV 732. An adhesion promoter such as an aminosilane can be included in the coating to increase bond strength between the coating and printhead front face.

20 Claims, 1 Drawing Sheet

HYDROPHOBIC COATING FOR A FRONT FACE OF A PRINTHEAD IN AN INK JET PRINTER

CROSS-REFERENCE TO RELATED APPLICATION

This application is related to U.S. patent application Ser. No. 07/874,863, filed Apr. 28, 1992, entitled "Application of a Front Face Coating to Ink Jet PrintHeads or PrintHead Dies", the disclosure of which is incorporated by reference herein.

BACKGROUND OF THE INVENTION

1. Field of the Invention

The present invention relates to a coating for a front face of a printhead in an ink jet printer and, more particularly, to a hydrophobic coating for a front face of a printhead in an ink jet printer, irrespective of whether it is a continuous or a drop-on-demand type, which controls the wetting characteristics of the front face to prevent ink accumulation on the front fact and ensure the directionality of a jet or ink ejected from the various nozzles of the printhead.

2. Description of Related Art

In ink jet printing, a printhead is provided, the printhead having at least one ink-filled channel for communication with an ink supply chamber at one end of the ink-filled channel. An opopsite end of the ink-filled channel has a nozzle opening from which doplets of ink are ejected onto a recording medium. In accordance with the ink droplet ejection, the printhead forms an image on the recording medium.

The ink droplets are formed as ink forms a meniscus at each nozzle opening prior to being ejected from the printhead. After a droplet is ejected, additional ink surges to the nozzle opening to reform the meniscus.

The direction of the ink jet determines the accuracy of placement of the droplet on the receptor medium, which, in turn, determines the quality of printing performed by the printer. Accordingly, precise jet directionality is an important property of a high quality printhead. Precise jet directionality ensures that ink droplets will be placed precisely where desired on the printed document. Poor jet directionality results in the generation of deformed characters and visually objectionable banding in half tone pictorial images. Particularly with the newer generation of thermal ink jet printers having higher resolution enabling printing at at least 300 dots per inch, improved print quality is demanded by customers.

Currently available ink jet printers provide accurate placement of ink droples on a page for only a very limited period of time. The current printers do not maintain high print quality by maintaining the directionality of the ink jet throughout the entire printing lifetime of the printer.

A major source of ink jet misdirection is associated with improper wetting of the front fact of the printhead containing at least one nozzle opening. One factor which adversely affects jet directional accuracy is the interaction of ink previously accumulated on the front face of the printhead with the exiting droplets. This accumulation is a direct consequence of the forces of surface tension, the accumulation becoming progressively severe with aging due to oxidation of the front face of the printhead. Ink may accumulate on the printhead front face due to either overflow during the refill surge of ink or the splatter of small droplets resulting from the process of ejecting droplets from the printhead. When accumulated ink on the front face of the printhead makes contact with ink in the channel (and in particular with the ink meniscus at the nozzle orifice), the meniscus distorts, resulting in an imbalance of forces acting on the ejected droplet. This distortion leads to ink jet misdirection. This wetting phenomenon becomes more troublesome after extensive use of the printhead as the front face either oxidizes or becomes covered with dried ink film. As a result, gradual deterioration of the generated image quality occurs. One way of avoiding these problems is to control the wetting characteristics of the printhead front face so that no accumulation of ink occurs on the front face even after extensive printing. Thus, in order to provide accurate ink jet directionality, wetting of the front face of the printhead is preferably suppressed. This can be achieved by rendering the printhead front fact hydrophobic.

In thermal ink jet printing, a thermal energy generator, usually a solid state resistor, is located in the channels near the nozzle openings at a predetermined distance from the nozzle openings. The resistors are individually addressed with a voltage pulse to momentarily vaporize the ink and form a bubble which expels the ink drople. As the bubble grows, the ink bulges from the nozzle and is contained as the meniscus by the surface tension of the ink. The rapidly expanding vapor bubble pushes the column of ink filling the channel toward the nozzle opening. At the end of the current pulse, the heater rapidly cools, and the vapor bubble begins to collapse. However, because of inertia, most of the column of ink that received an impulse from the exploding bubble continues its forward motion and is ejected from the nozzle opening as an ink droplet. As the bubble begins to collapse, the ink remaining in the channel between the nozzle opening and the bubble starts to move toward the collapsing bubble, causing a volumetric contraction of the ink at the nozzle and resulting in the separation of the bulging ink as a droplet. The acceleration of the ink out of the nozzle while the bubble is growing provides the necessary momentum and velociy to the droplet in a substantially straight line direction toward the recording medium. However, puddling of ink in contact with the nozzle opening in the front face of the thermal ink jet printhead will cause deflection of the droplet from a sraight line path and, accordingly, misdirection. Therefore, the wetting characteristics of the front fact of the printhead are critical to accurate printing.

All the different types of ink jet printheads include an array of nozzles. Such nozzles of a thermal print head may be formed of silicon wafers using orientation dependent etching (ODE) techniques. The use of silicon wafers is advantageous because ODE techniques can form structures, such as nozzles, on the wafers in a highly precise manner. Moreover, the structures can be fabricated efficiently at low cost. The resulting nozzles are generally triangular in cross-section. Thermal ink jet printheads made by the above-mentioned ODE techniques typically comprise a channel plate which contains a plurality of nozzle-defining channels located in a lower surface thereof bonded to a heater plate having a plurality of resistive heater elements formed on an upper surface thereof, the heater plate being arranged so that a heater element is located in each channel. The upper surface of the heater plate may include an insulative layer which is patterned to form recesses explosing the indiviudual heating elements. The insulative layer is referred to as a "pit layer" and is sandwiched between the channel plate and the heater plate so that the nozzle containing front face may have three layers: 1) the channel plate; 2) the pit layer; and 3) the heater plate.

The heater and channel plates are typically formed from silicon, while the pit layer, sandwiched between the heater and channel plates, is formed from a polymer. Since the front face of the printhead includes these different materials, a coating material, such as a water-repellent material, will not adverse equally well to these different materials resulting in a coating which is not uniformly ink repellent. Thus, it is difficult to provide a surface coating which is uniformly ink repellent over a long period of time for ink jet printheads.

Additionally, the printer is typically used in ink which contains a glycol and water. Glycols and other similar materials are referred to as humectants, which substances promote the retention of moisture. For a coating material to be effective for any length of time, it must both repel and be resistant to glycol-containing inks.

Further, it is difficult to apply a coating to a face of an ink jet nozzle opening. Many materials will not adhere sufficiently to the silicon wafer face. While it is desirable to suppress the wetting property of the nozzle jet surface, it may be undesirable to allow any coating material to enter the channel of the nozzle. If the walls of the channel become coated with ink-repellent material, proper refill of the channel may be inhibited. Refill of each channel depends on surface tension and must be completely in time for the subsequent volley of droplets to be fired. If the refill process is not completely by the time the next droplet is fired, the meniscus may not be flush with the outer edge of the nozzle opening, resulting in misdirection. Further, an incompletely filled channel causes the ink droplet size to vary, which also leads to print quality degradation.

U.S. Pat. No. 4,392,907 to Shirato et al. discloses a method for producing a printhead for ejecting a recording liquid in an action chamber from an orifice in a state of small droplets. The printhead comprises a flat plate provided on a substrate. A protective layer and a filling layer can be provided on the substrate. The protective and filling layers prevent the direct contact of a heating resistor or electrode with the recording liquid or ink, preventing the oxidation of the resistor or electrode and the composition of the ink. The reference provides no disclosure of a coating for the front face of the printhead to ensure the directionality of ink droplets ejected therefrom.

U.S. Pat. Nos. 4,555,062 and 4,583,690 to You disclose ionic surface preparations for nozzles used in spraying ink droplets and ink jet printers. An oppositely charged ionic anti-wetting agent is dissovled in the sprayed fluid to reduce the wetting of the nozzle surfaces. The preparation is not applied to the front face of a printhead to prevent the accumulation of ink thereon.

Thus, the ability to change the wetting charcteristics of the front face of a printhead to simply and effectively ensure directionality of an ink droplet is needed.

OBJECTS AND SUMMARY OF THE INVENTION

An object of the present invention is to provide an ink jet printhead which ensures the directionality of ejected ink droplets.

Another object of the present invention is to provide an ink jet printhead having a front face with low wettability.

Another object of the present invention is to provide an ink jet printhead having a front face which prevents ink accumulation at the nozzle openings.

A further object of the present invention is to provide an ink jet printhead which maintains directionality of an ink jet throughout the entire printing lifetime of a printer.

These and other objects of the invention are achieved by providing an ink jet printhead having a coating on a front face thereof. The coating controls the wetting characteristics of the front face to prevent ink accumulation on the front face. The coating comprises an epoxy adhesive resin such as EPON 1001F, for example, doped with a silicone rubber compound such as RTV 732. The coating can be provided in the form of a 24% solution of EPON 1001F and a 30:70 mixture of xylene and methyl iso-butyl ketone by weight doped with 1% by weight of RTV 732. Such a coating enables the directionality of an ink jet to be maintained for the printing lifetime of the printer. An adhesion promoter such as a silane component, for example, can also be included to provide a highly adherent, long lasting coating.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
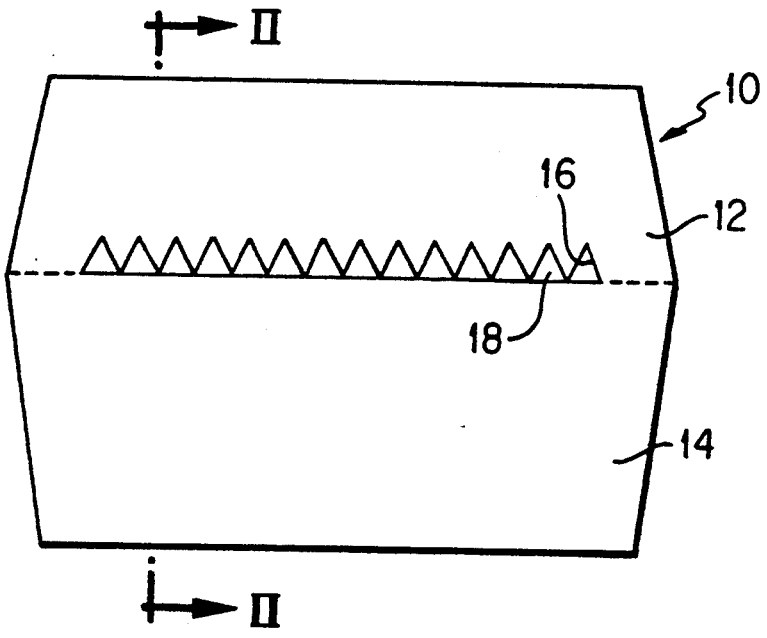
FIG. 1 is a front view of a printhead in accordance with the present invention.

Referring now to the drawings and particularly to FIG. 1 thereof, a printhead 10 is illustrated in accordance with the present invention. Printhead 10 includes a first or upper substrate 12 and a second or lower substrate 14. The substrates are formed of dielectric or semiconductor material, such as silicon, GaAs (gallium aresenide), glass, sapphire, alumina, AlN (aluminum nitride) or BeO (beryllium oxide). The semiconductor substrates may be doped.

Upper substrate 12 is a channel plate having elongated V-shaped channels 16 formed in a bottom thereof by ODE techniques, for example. Lower substrate 14 is an actuator plate having a plurality of resistive heater elements (not shown) formed in an upper surface thereof. The heater elements of actuator plate 14 correspond in number and position to the channels 16 in channel plate 12.

Channel plate 12 and actuator plate 14 are coupled to one another for example, by bonding, such that the resistive heater elements face the channels 16. Channels 16 define ink channels which communicate with an ink manifold (not shown). Once the channel plate and actuator plate are coupled to one another, to achieve coplanarity along the front face of the printhead 10 to produce nozzles 18, a dicing action, for example, is performed.

Figure 2:
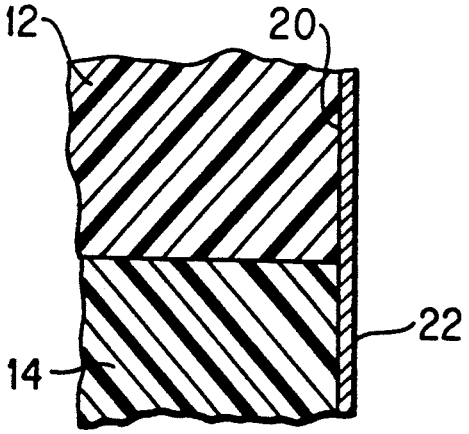
FIG. 2 is a cross-sectional view of the printhead of FIG. 1 taken along line II—II.

To avoid ink accumulation on the front face of the printhead adjacent the nozzles 18, a hydrophobic coating 22, as illustrated in FIG. 2, is provided on the printhead front face 20. This hydrophobic coating 22 changes the wetting characteristics of the front face to prevent ink from accumulating near the nozzles and interfering with the jetting of the ink droplets.

Coating 22 comprises a silcone rubber compound as a dopant and an epoxy adhesive resin. For illustrative purposes, the silicone rubber compound RTV 732 made by Dow Corning and the epoxy adhesive resin EPON 1001F made by Shell Oil Company are described. Coating 22 may also include an adhesion promoter such as a silane component in order to obtain a more strongly adherent and longer lasting coating.

The coating will be further explained with reference to the following example.

EXAMPLE

A 24% solution of EPON 1001F in a 30:70 mixture of xylene and methyl iso-butyl ketone by weight was doped with 1% by weight of Dow Corning RTV 732. The solution was stirred overnight. A film of the solution was spun on a mylar wafer by dispensing 3 ml of the solution on the water, and spinning the wafer at 2000 RPM with twenty seconds. The film was then transferred to the front faces of individual dies by placing the EPON-coated mylar disk against the dies, previously heated to 65° C. and either using a roller coater or a straight-edge blade to transfer the coating from the mylar disk to the die. The coated dies are than annealed at 160° C. for 1 hour. Afterthe film was annealed, the film was cooled to room temperature. The contact angles of the film were measured against different solvents. The values obtained were as follows:

| | Advancing Angle | Receding Angle |
|---|---|---|
| Water | 110°, 114°, 114° | 97°, 90°, 90° |
| Ink 1 | 95°, 97°, 105° | 73°, 79°, 70° |
| Ink 2 | 83°, 85°, 84° | 48°, 57°, 55° |
| Ink 3 | 69°, 70°, 69° | 53°, 49°, 39°. |

In accordance the obtained values, it can be seen that both the advancing and receding contact angles were maintained over repeated measurements at the same spots. The exemplary coating thus provides desirable jetting characteristics of the ink drops without adversely affecting drop velocity. The use of the epoxy adhesive resin, EPON 1001F, enables enhanced bonding capability to most surfaces. An even stronger and longer lasting bond between the coating and the adherend may be achieved by incorporating an adhesion prometer such as an aminosilane in the formulation. The coating is repellent to both water and various inks such as ink-1, ink-2 and ink-3 as shown by the above-mentioned advancing and receding contact angle measurements. The coating is relatively inexpensive and its application is very simple.

Once the printhead front face 20 is coated with the hydrophobic coating 22, ink will not collect at the nozzles due to the reduced wettability of the outer front face surface. Thus, the coating eliminates a major source of misdirection of ejectedink droplets from the printhead, ensuring that the droplets will be accurately directed and placed on the recording medium.

While the invention has been described with reference to a particular preferred embodiment, the invention is not limited to the specific example described above. It is evident that many alternatives, modifications and variations will be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. A coating for a front face of a printhead in a thermal ink jet printer, comprising:

an epoxy adhesive resin; and a silicone rubber compound, said silicone rubber compound being a dopant in the epoxy adhesive resin.

2. The coating according to claim 1, further comprising an adhesion promoter for providing increased bond strength of said coating.

3. The coating according to claim 2, wherein said adhesion promoter is 0.1% by weight of an aminosilane.

4. The coating according to claim 1, wherein said coating is hydrophobic.

5. The coating according to claim 1, wherein said coating is an ink repellent.

6. The coating according to claim 1, wherein said epoxy adhesive resin is provided in a solution containing a mixture of xylene and methyliso-butyl ketone.

7. The coating according to claim 6, wherein said epoxy adhesive resin is EPON 1001F.

8. The coating according to claim 7, wherein substantially a 24% solution of said EPON 1001F is provided in substantially a 30:70 mixture of said xylene and said methyl iso-butylketone by weight.

9. The coating according to claim 1, wherein said silicone rubber compound is RTV 732.

10. The coating according to claim 9, wherein substantially a 1% by weight amount of said RTV 732 is said dopant in said epoxy adhesive resin.

11. A thermal ink jet printhead, comprising:

a first substrate defining a channel plate having a front face;

a second substrate defining an actuator plate having a front face, said first substrate front face and said second substrate front face being substantially flush with one another, a lower surface of said first substrate and an upper surface of said second substrate disposed in a facing relationship and defining at least one ink channel therebetween, each said ink channel terminating in a nozzle in said front face of at least said first substrate; and a coating on said flush front faces, said coating comprising an epoxy adhesive resin and a silicone rubber compound, said silicone rubber compound being a dopant in the epoxy adhesive resin.

12. The printhead according to claim 11, wherein said coating is hydrophobic.

13. The printhead according to claim 11, wherein said coating is an ink repellent.

14. The printhead according to claim 11, wherein said epoxy adhesive resin is provided in a solution containing a mixture of xylene and methyl iso-butyl ketone.

15. The printhead according to claim 14, wherein said epoxy adhesive resin is EPON 1001F.

16. The printhead according to claim 15, wherein substantially a 24% solution of said EPON 1001F is provided in substantially a 30:70 mixture of said xylene and said methyl iso-butyl ketone by weight.

17. The printhead according to claim 11, wherein said silicone rubber comopund is RTV 732.

18. The printhead according to claim 17, wherein substantially a 1% by weight amount of said RTV 732 is said dopant in said epoxy adhesive resin.

19. The printhead according to claim 11, wherein said coating includes an adhesion promoter for providing increased bond strength of said coating to said flush front faces.

20. The printhead according to claim 19, wherein said adhesion promoter is 0.1% by weight of an aminosilane.

* * * * *

UNITED STATES PATENT AND TRADEMARK OFFICE

CERTIFICATE OF CORRECTION

PATENT NO. : 5,218,381

DATED : June 8, 1993

INVENTOR(S) : Ram S. NARANG, Stephen F. POND, Robert P. ALTAVELA, David J. COLLINS and Robert A. HAROLD, Sr.

It is certified that error appears in the above-identified patent and that said Letters Patent is hereby corrected as shown below:

On the title page:

In section [56] References Cited, change "4,552,062" to --4,555,062--.

Signed and Sealed this

Twenty-fifth Day of January, 1994

Bruce Lehman

BRUCE LEHMAN

*Commissioner of Patents and Trademarks*

*Attest:*

*Attesting Officer*